US006769627B2

(12) United States Patent
Carhuff et al.

(10) Patent No.: US 6,769,627 B2
(45) Date of Patent: Aug. 3, 2004

(54) FLUID DISPENSING DEVICE WITH SELF-CLEANING NOZZLE AND METHODS OF USE

(75) Inventors: Peter W. Carhuff, Gaylordsville, CT (US); Edward L. Dickinson, Littleton, MA (US); Andrew C. Harvey, Waltham, MA (US); Edward M. Kolvek, West Newbury, MA (US)

(73) Assignee: Nestec S.A., Vevey (CH)

( * ) Notice: Subject to any disclaimer, the term of this patent is extended or adjusted under 35 U.S.C. 154(b) by 107 days.

(21) Appl. No.: 10/133,126

(22) Filed: Apr. 26, 2002

(65) Prior Publication Data

US 2003/0201337 A1 Oct. 30, 2003

(51) Int. Cl.[7] ..... B05B 1/28

(52) U.S. Cl. ..... 239/120; 239/104; 239/106; 239/108; 239/110; 239/119

(58) Field of Search ..... 239/104, 106, 239/108, 110, 112, 113, 119, 120, 121, 122, 451, 437, 438, 453, 456; 222/129.1, 129.3, 129.4, 145.2, 148

(56) References Cited

U.S. PATENT DOCUMENTS 739,788 A * 9/1903 Morcom et al. ..... 239/110
924,566 A * 6/1909 Morcom ..... 239/113
4,331,299 A * 5/1982 Culbertson et al. ..... 239/112
5,226,565 A * 7/1993 Hladis et al. ..... 239/112
5,344,073 A * 9/1994 Waryu et al. ..... 239/112
5,503,179 A * 4/1996 Till ..... 137/240

FOREIGN PATENT DOCUMENTS

DE 94 01 472 3/1994
FR 2 649 687 1/1991

* cited by examiner

*Primary Examiner*—Robin O. Evans
(74) *Attorney, Agent, or Firm*—Winston & Strawn LLP

(57) ABSTRACT

The invention relates to a fluid or beverage dispensing device having self-cleaning dispensing nozzle. The device includes a body provided with a conduit having a first end to which a dispensing nozzle is connected, and a second end to which a fluid inlet line is intended to be connected. The device further includes a collector member that can move relative to the body between a first dispensing position in which the outlet of the nozzle is released from the collector member and a second cleaning position in which the collector member is placed in front of the nozzle outlet to collect any fluid that exits the outlet.

21 Claims, 3 Drawing Sheets

FLUID DISPENSING DEVICE WITH SELF-CLEANING NOZZLE AND METHODS OF USE

BACKGROUND OF THE INVENTION

The present invention generally relates to devices for dispensing fluids, in particular beverages. More particularly, the invention concerns devices that have self cleaning dispensing nozzles intended in particular to be used in "post-mix" type dispensing machines for dispensing microbiologically sensitive products, such as milk-based beverages, which are capable of obstructing the dispensing nozzle or allowing micro-organisms to grow therein. In addition, the present device can also be used for dispensing other types of beverages.

The invention also relates to a method for cleaning and a method for setting a dispensing nozzle to a predetermined temperature.

Post-mix type beverages are widely used in beverage dispensers located in fast food restaurants. In such dispensers, a concentrated beverage or syrup is mixed with several measures of water and is then fed to a nozzle to make a finished beverage ready for consumption by the consumer. It will be understood that, for obvious reasons of hygiene, the dispensing nozzles have to be cleaned regularly in order to prevent a build up of bacteria that can particularly develop in the supply lines that bring the concentrate to the dispensing nozzle. These problems are all the more important when the beverages dispensed include milk-based products insofar as these products are very sensitive to bacterial pollution and quickly decompose or deteriorate to poor tasting or inedible products.

Moreover, after a certain number of uses, solid residues of concentrate build up in the nozzle. In addition to altering the taste and/or quality of dispensed beverages, these build-ups also can disrupt the supply of the liquid or even clog the nozzle to reduce or terminate its dispensing ability.

In order to overcome these problems, maintenance personnel regularly dismantle, check and cleanse such beverage dispensing nozzles. These maintenance operations have the drawbacks of being expensive, requiring that the dispenser be taken out of service to be momentarily inoperative, and necessitating contact of the parts that can result in recontamination.

Certain manufacturers have attempted to overcome these drawbacks by proposing dispensers that have structures that allow the nozzles to be rinsed and/or cleaned in order to avoid manual dispenser maintenance. Examples can be found for example in U.S. Pat. Nos. 4,979,527 and 5,749,494. However, the structures proposed to date have proved to be complex and expensive but without providing the desired improvements in cleaning efficiency.

Another problem that these beverage dispensers generally have is linked to the dispensing of hot or cold beverages at the desired temperature, which for hot beverages is typically between 65 and 75° C. Indeed, after flowing through supply pipes, mixing with beverage concentrate at 25° C., and finally passing through the nozzles, water that is initially heated to approximately 90° C. generally has a temperature of less than 55° C. when being dispensed from the nozzle. In a fast food restaurant, this temperature is often insufficient for dispensing a so-called "hot" beverage, particularly if one also takes account of the average time necessary for the consumer to find a table and sit down, during which time the beverage continues to cool. A similar problem arises when one wishes to dispense a cold beverage, as the beverage begins to warm to room temperature. This problem is made worse when a single dispensing device is used to alternatively dispense hot and cold beverages, as the temperature of one counteracts that of the other. Accordingly, there is a need for improved dispensing devices that are not subject to these problems and disadvantages.

SUMMARY OF THE INVENTION

The present invention now resolves the problems of the prior art by providing a fluid dispensing device for dispensing fluids such as beverages. This device includes a self-cleaning nozzle assembly, which has a simple and economical structure and which allows efficient rinsing and cleaning (hereinafter referred to by the general term "cleaning") of the dispensing nozzle.

A fluid dispensing device of this type provides a number of advantages:

- it allows beverages to be dispensed in optimum conditions of hygiene;
- it allows beverages to be dispensed with a consistent taste quality; and
- it limits heat exchanges between the water and the conduits and nozzle when preparing and dispensing hot or cold beverages.

The invention specifically relates to a fluid dispensing device comprising: a self-cleaning dispensing nozzle having an outlet; a body having an exterior surface and being provided with a conduit having a first end to which the dispensing nozzle is connected and a second end which can receive a fluid inlet line; a collector member which can move relative to the body between a first dispensing position in which the nozzle outlet is released from the collector member and a second cleaning position in which the collector member can collect fluid that exits the nozzle outlet.

As a result of these features, one obtains a dispensing device with a simple structure wherein, particularly, the nozzle does not need to be dismantled by specialized personnel to be rinsed and cleaned. Indeed, the nozzle can easily be brought into the cleaning position by entering a manual or automatic command for automatic rinsing and cleaning after each beverage is dispensed or with any other desired frequency.

According to a preferred embodiment of the invention, the collector member has the general shape of a sleeve in which the body and the dispensing nozzle are guided for sliding movement along an axial direction. The inner wall of the sleeve along with the outer wall of the body define, in the cleaning position, a cleaning chamber into which extends the dispensing nozzle outlet.

With these features, a cleaning liquid or rinsing fluid (hereinafter referred to by the general term "cleaning fluid") can flow not only into the nozzle but also at the periphery of its outlet so that complete rinsing and cleaning thereof is obtained. In particular, the nozzle can be cleaned thoroughly by the flow of a cleaning fluid such as a detergent or caustic solution. The arrangement of the invention also allows a satisfactory level of hygiene to be maintained for the nozzle during operation via the flow of hot water or water at ambient temperature through the conduit to physically flush out the micro-organisms and prevent them reaching unhygienic levels. The arrangement of the invention also allows to remove scale deposit in the device via the flow of an acid solution or any other suitable descaling agent.

According to another aspect, the invention also relates to a method for cleaning a dispensing nozzle of a fluid dispensing device comprising: the dispensing nozzle; a body having an exterior surface and being provided with a conduit having a first end to which the dispensing nozzle is connected and a second end which can receive a fluid inlet line; a collector member which can move relative to the body between a first dispensing position in which the nozzle outlet is released from the collector member and a second cleaning position, with the nozzle being initially in the dispensing position. This method comprises the steps of: placing the nozzle facing the collector member; flowing a cleaning or rinsing fluid through the conduit and nozzle; collecting the cleaning or rinsing fluid that exits the nozzle in the collector member; and replacing the nozzle back into the initial position.

According to yet another aspect, the invention concerns a method for setting the temperature of a dispensing nozzle of a fluid dispensing machine comprising: the dispensing nozzle; a body having an exterior surface and being provided with a conduit having a first end to which the dispensing nozzle is connected and a second end which can receive a fluid inlet line; a collector member which can move relative to the body between a first dispensing position in which the nozzle outlet is released from the collector member and a second temperature setting position in which the collector member is placed in front of the nozzle outlet, with the nozzle being initially in the dispensing position. This method comprises the steps of: placing the nozzle facing the collector member; causing a temperature setting fluid to flow at a determined temperature through the conduit and nozzle; collecting the fluid coming out of the nozzle in the collector member; and then replacing said nozzle in the initial position.

As a result of these features, the temperature of the dispensing nozzle can be set, i.e. it can be preheated or cooled, simply via the flow of a small quantity of fluid respectively at a high or low temperature in order to bring the temperature of the surfaces of the nozzle in contact with the beverage to be dispensed to the closest possible temperature to the desired temperature. The hot beverage required by the consumer can then be dispensed at a satisfactory temperature. Since this temperature setting operation is quick, it can easily form part of the beverage dispensing cycle and the nozzle can thus be preheated or cooled before each beverage is dispensed.

BRIEF DESCRIPTION OF THE DRAWINGS

Other characteristics and advantages of the present invention will appear in the following description of a preferred embodiment of the fluid dispensing device, this embodiment being given by way of non-limiting example with reference to the annexed drawings, in which.

DETAILED DESCRIPTION OF THE PREFERRED EMBODIMENTS

Figure 1:
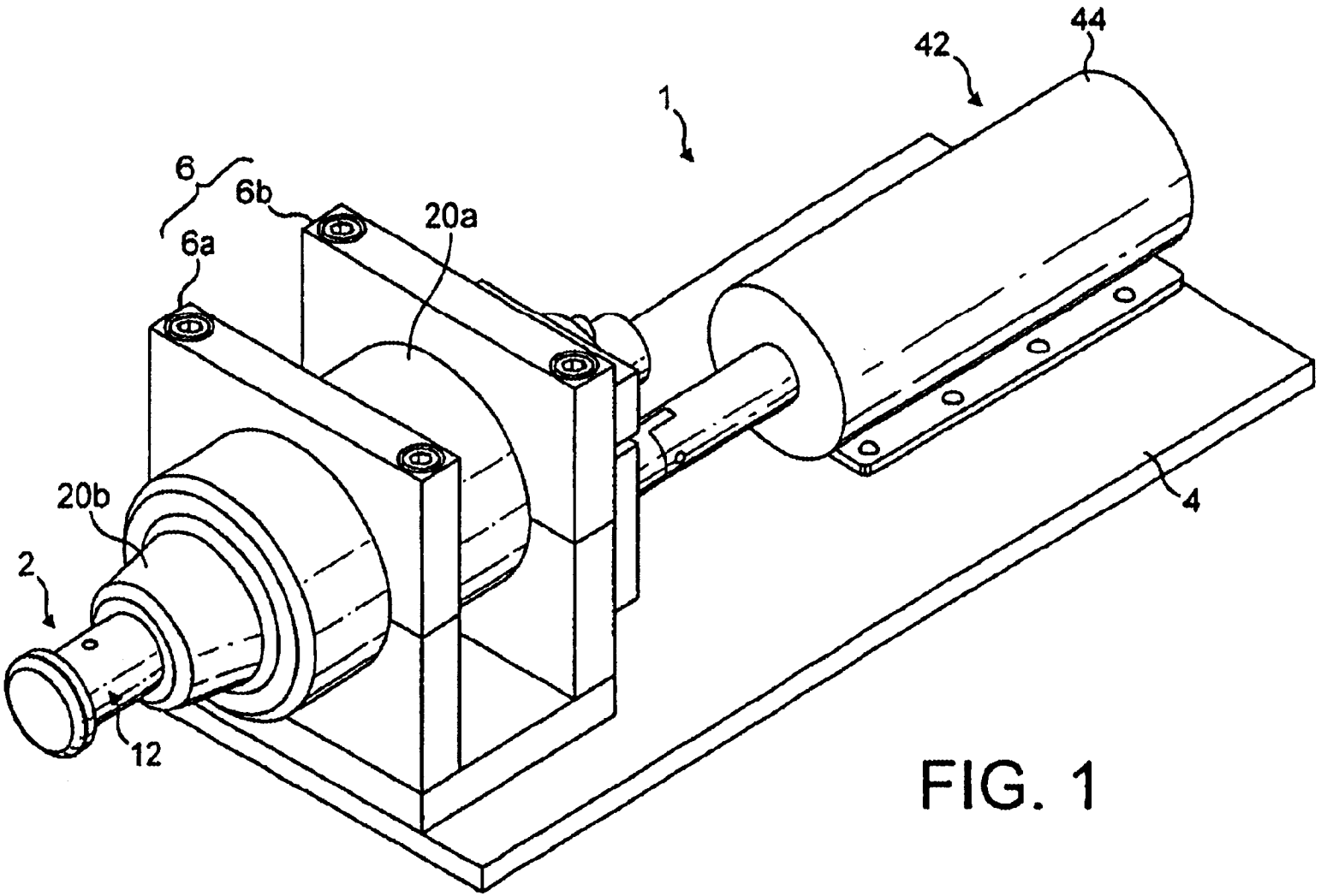
FIG. 1 is a perspective view of an embodiment of the dispensing device according to the invention.

With reference first of all to FIG. 1, one can see a fluid-dispensing device in particular for beverages, comprising a self-cleaning nozzle designated by the general reference 1. Dispensing device 1 is particularly suited to being mounted in post-mix type beverage dispensing machines which allow a concentrate, for example a coffee, chocolate and/or milk based concentrate or the like to be mixed with hot or cold water with the resulting liquid food or beverage product ready to be subsequently dispensed upon demand. Of course the device of the invention can be used in any type of beverage dispensing machine.

Device 1 comprises a dispensing nozzle 2 mounted on a base plate 4 via securing means 6 which can be formed of two brackets 6*a*, 6*b* as illustrated in the drawings. Device 1 is intended to be mounted and secured inside a dispensing machine (not shown) with the aid of base plate 4.

Figure 2:
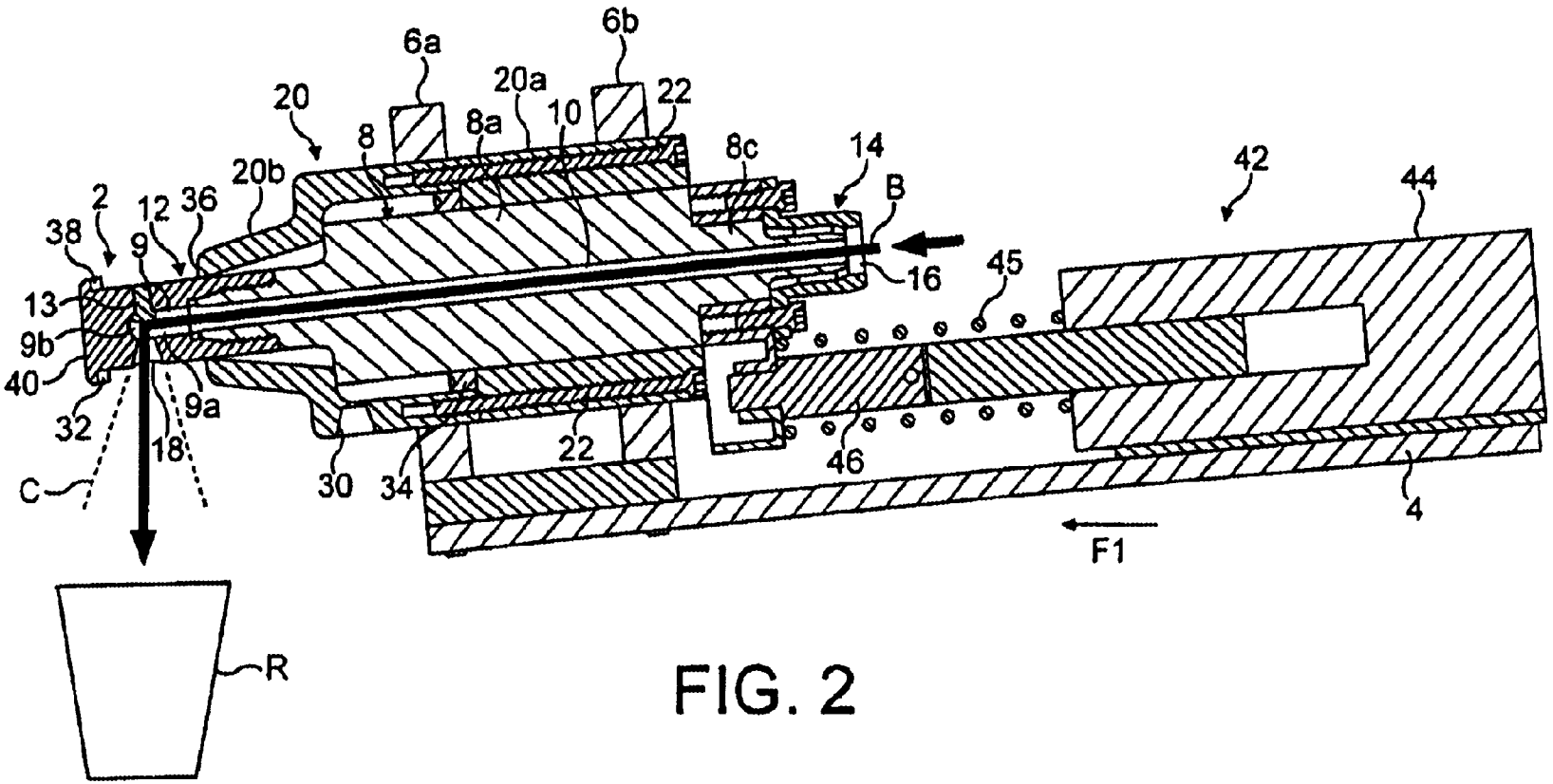
FIG. 2 is a longitudinal cross-section of the dispensing device illustrated in FIG. 1, said device being shown in a dispensing position.

Referring also to FIG. 2, nozzle 2 comprises a body 8 of generally cylindrical shape. Body 8 comprises a middle section 8*a*, and two end sections 8*b*, and 8*c* having a smaller diameter than that of middle section 8*a*. Body 8 is provided with a through conduit 10 extending longitudinally at the centre of body 8. Conduit 8 comprises a first end portion to which a nozzle head 12 is connected and a second end portion intended to be connected to a fluid feed line (not shown) via a conduit (also not shown). In this example, nozzle head 12 is screwed onto the free end of section 8*b* of body 8 and a connector 14 is secured to the free end of section 8*c*. Nozzle head 12 comprises a channel 9 bent at a right angle having a first portion 9*a* connected to conduit 10 and a second portion 9*b* opening out onto the exterior and in which a bevelled cylinder 13 is screwed. Bevelled cylinder 13 delimits with portion 9*b* of channel 9 an annular fluid or beverage orifice 18, the shape of which determines the shape of the fluid jet. In the example illustrated in FIG. 2, the jet has the shape of a cone C shown in dotted lines. Connector 14 thus defines a fluid or beverage inlet 16 and the fluid or beverage orifice 18 defines a fluid or beverage outlet. It will be noted that screwing nozzle head 12 onto body 8 and screwing bevelled cylinder 13 into nozzle head 12 enables these elements to be easily interchanged and makes device 1 advantageously flexible. In particular, device 1 can be rapidly and easily adapted to beverages requiring different sizes for beverage outlet 18 or different jet shapes.

Dispensing nozzle 2 further comprises a collector member 20 that has the general shape of a cylindrical sleeve open at both ends. Collecting sleeve 20 has a cylindrical rear section 20*a* extended by a converging truncated front section 20*b*. Sleeve 20 is secured in brackets 6*a*, 6*b*. In the example shown, sleeve 20 is made of two parts connected to each other by a plurality of screws 22 extending longitudinally in the thickness of the walls of said sleeve parts. Body 8 and nozzle head 12 are guided and slide axially inside sleeve 20.

Figure 3:
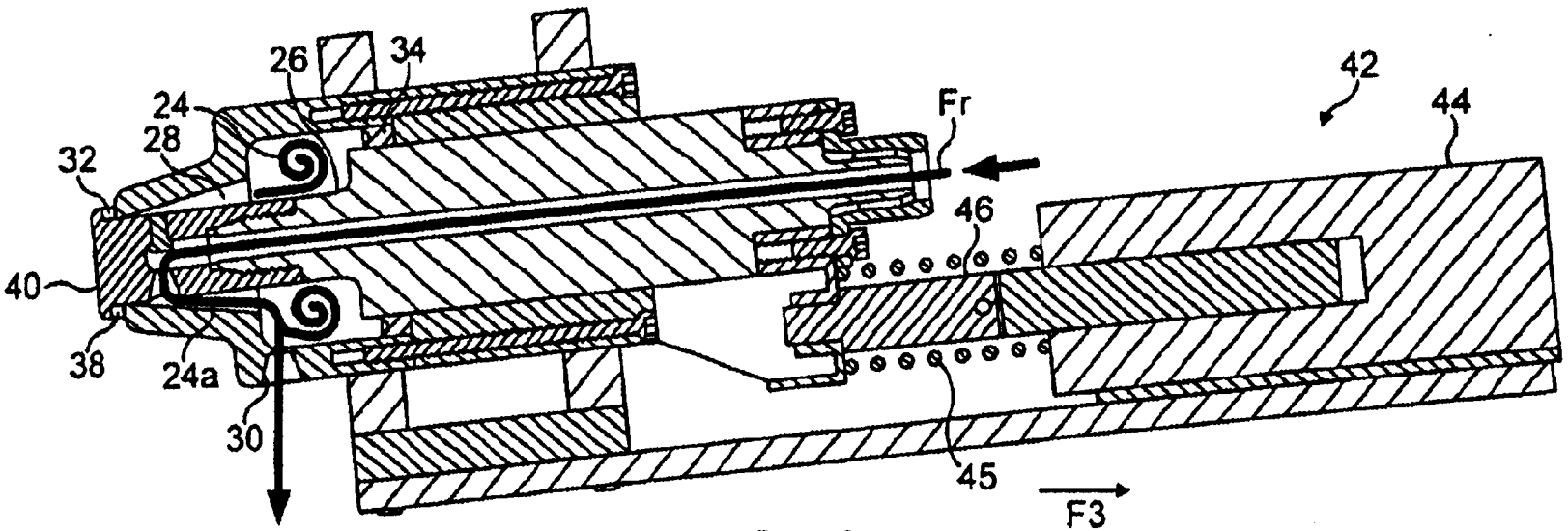
FIG. 3 is a longitudinal cross-section of the dispensing device illustrated in FIG. 1, said device being shown in a cleaning position.

More precisely, body 8 and nozzle head 12 are mobile relative to sleeve 20 between a first position, called the dispensing position, shown in FIG. 2, in which nozzle head 12 is released from sleeve 20, i.e. it is outside sleeve 20 so as to be able to dispense a beverage into a receptacle R, and a second position called the cleaning position shown in FIG. 3, in which at least a part of sleeve 20 is placed in front of beverage outlet 18 to collect a cleaning fluid coming out of the latter.

In the dispensing position, nozzle head 12 projects from the front section 20*b* of sleeve 20 and a beverage B arriving via conduit 10, symbolised by a bold line in FIG. 2, can be dispensed through beverage outlet 18 of nozzle head 12 into a receptacle R arranged below beverage outlet 18.

In the cleaning position, inner wall 24 of sleeve 20 defines with the outer surface 26 of body 8, a cleaning chamber in which the nozzle head 12 and in particular beverage outlet 18 is housed. Chamber 28 communicates with the exterior via a drain orifice 30 located in an inner wall of sleeve 20. Depending on the particular case, drain orifice 30 is connected either to the sewage system, or to a recuperation tank in order to allow the cleaning fluid to be put back into circulation in a closed circuit via a tank and a pump device (not shown). Two sealing gaskets, respectively front gasket 32 and back gasket 34, arranged on either side of beverage outlet 18, seal chamber 28.

More precisely, front gasket 32 is formed by a sealing joint and is arranged between a front surface 36 of truncated section 20*b* around the front opening of sleeve 20 and a complementary surface 38 defined by a collar 40 provided in the front part of nozzle head 12. It will be noted that collar 40 is located outside sleeve 20 whether dispensing device 1 is in the dispensing position or in the cleaning position. It will be noted that frontal surface 36 and complementary surface 38 are preferably plane in order to assure proper sealing of chamber 28 in the cleaning position. Back gasket 34 is formed by a sealing joint arranged between the cylindrical portion of inner wall 24 of sleeve 20 and median section 8*a* of body 8. Typically, front sealing gasket 32 is an O-ring type joint and back sealing gasket 34 is a lip seal type joint. In the cleaning position, body 8 is moved so that collar 40 abuts against frontal surface 36 in order to make chamber 28 watertight.

Thus, a cleaning fluid Fr symbolised by a bold line in FIG. 3, passing through conduit 10, can flow into conduit 10 of nozzle head 12, then into chamber 28, and around nozzle head 12 before flowing through outlet 30 into the sewage system or a recuperation tank.

It will be noted in this regard that front gasket 32 has been chosen to have a smaller diameter to that of back gasket 34 in order to generate a force differential when the pressure increases in cleaning chamber 28, which tends to apply collar 40 against the frontal surface of sleeve 20 and improves water tightness.

It will also be noted in this regard that the inner geometry of chamber 28 facilitates complete emptying of the cleaning fluid after a cleaning cycle. In particular, wall 24*a* of cleaning chamber 28 arranged opposite outlet 18 of nozzle 12 is inclined with respect to the horizontal so that a fluid flows in the direction of drain orifice 30.

In order to assure the relative movement between sleeve 20 and body 8, the latter is connected to actuating means 42 secured to base plate 4.

In the example illustrated, these means 42 are formed of a solenoid electromagnetic actuator 44 associated with a return spring 45. The rod 46 of actuator 44 is secured to section 8*a* of body 8 and return spring 45 is arranged around rod 46 between body 8 and actuator 44. Thus, in response to a control signal originating from a control circuit (not shown), actuating means 42 allow device 1 to be automatically brought into its dispensing and cleaning positions. More precisely, in the absence of any signal on actuator 44, the solenoid is de-energised and return spring 45 tends to push body 8 in the direction of arrow F1 to bring dispensing device 1 into the dispensing position shown in FIG. 2. In the presence of a signal on actuator 44, the solenoid is energised and tends to pull body 8 in the direction of arrow F2 to bring dispensing device 1 into the cleaning position shown in FIG. 3.

It goes without saying that any other type of actuator can be used provided it allows a translation movement to be impressed on body 8 with respect to sleeve 20. By way of example, one could envisage replacing electromagnetic actuator 44 with a drive device with gears or by an electric actuator.

It will also be noted that dispensing device 1 may advantageously be arranged so that conduit 10 is inclined with respect to the horizontal in order to promote complete drainage of the conduit into a receptacle R located underneath nozzle outlet 18 when a beverage is being dispensed. Of course, the inclination of conduit 10 is such that the axis of dispensing cone C of nozzle head 12 is substantially vertical to facilitate correct filling of receptacle R.

The dispensing device according to the invention can operate either in dispensing mode or in cleaning mode, and in temperature setting mode. These operating modes will be described hereinafter with reference to FIGS. 2 and 3.

In FIG. 2, the device according to the invention is shown in the dispensing mode. In this operating mode, actuator 44 is de-energised and spring 45 pushes body 8 in the direction of arrow F1 to bring beverage outlet 18 of nozzle head 12 outside sleeve 20. A beverage from the feed line thus flows into the conduit and then into nozzle 12 before being dispensed into a receptacle R arranged underneath outlet 18.

In FIG. 3, the device according to the invention is shown in the cleaning mode. In this operating mode, actuator 44 is energised and rod 46 of the actuator pulls body 8 in the direction of arrow F3 to bring collar 40 to stop against frontal face 36 of sleeve 20 and thus to close cleaning chamber 28 for the cleaning operation. In this position, a cleaning fluid Fr which flows into conduit 10 and through dispensing nozzle 12 fills chamber 28 and is evacuated through drain orifice 30 either to the sewerage system or to a tank associated with a pump, in order to be circulated again subsequently. Cleaning fluid Fr, which flows in the nozzle and all around it in chamber 28, allows complete and efficient cleaning to be achieved without any part of nozzle 12 having to be dismantled. The cleaning fluid will preferably be chosen as a function of the type of beverage, which is dispensed by the nozzle. Typically, for milk-based beverages, the cleaning fluid will be chosen from among the group including caustic soda, low foaming dishwasher solutions including surfactants and components which break down proteins, chlorinated, or phenolated solutions. The cleaning fluid also encompasses descaling agents such as acid solutions.

It is clear from the foregoing that dispensing nozzle 12 of dispensing device 1 according to the invention can be cleaned simply by placing nozzle head 12 so that its outlet 18 is in chamber 28, causing a cleaning fluid Fr to flow through conduit 10 and nozzle head 12, collecting fluid Fr in chamber 28, preferably so that it flows around nozzle head 12. Once these operations have been performed, nozzle 12 can be replaced in its dispensing position ready to dispense a beverage.

It will be noted that dispensing device 1 according to the invention can advantageously be used to set a dispensing nozzle to a predetermined temperature, i.e. for preheating or cooling the nozzle before dispensing beverages. In order to do this, device 1 is placed in a position similar to the cleaning position, and then a temperature setting fluid is made to flow into the conduit and through nozzle 12. In this position, the fluid fills chamber 28 and flows around nozzle head 12 so that, by heat conduction, it can either transfer heat to nozzle head 12 and to conduit 10 if it is a fluid with a higher temperature than the latter in order to heat them, or absorb the heat from nozzle head 12 and conduit 10 if it is a fluid with a lower temperature than them in order to cool them. The temperature setting fluid flowing in chamber 28 is then evacuated from chamber 28 via drain orifice 30 and nozzle 2 is replaced in its dispensing position ready to dispense a beverage.

Since the nozzle may be preheated or pre-cooled, depending on the particular case, the thermal heat transfers from conduit 10 and the nozzle head to the beverage and vice versa depending on the relative temperature of each of them, will be limited so that the beverage can be dispensed at a temperature almost equal to the desired dispensing temperature. As such, conduit 10 and nozzle head 12 may be constructed of any food grade material of proper mechanical properties. Should the materials have poor heat transfer properties (for example plastic), less preheating or precooling is required to attain the proper product dispense temperature. Should the materials chosen have heat transfer properties similar to metal (for example stainless steel) then the preheating and precooling via flow of temperature adjusting fluid through the nozzle is of more importance. Preferably, if one wishes to preheat nozzle head 12 and conduit 10, water vapor will be circulated therein. Typically, a quantity of steam comprised between 0.5 and 5 ml is sufficient to obtain preheating for dispensing a beverage whose temperature will be comprised between 65 and 75° C. into a conduit 10 and a nozzle head made of stainless steel. Cold water may also be circulated through conduit 10 and nozzle head 13 such that a cold drink dispensed following a hot drink will not have an increase in temperature from hot surfaces of the device.

It is to be noted that feed conduit 10 and the nozzle head are common to the beverage to be dispensed and the rinsing fluid so that the configuration of device 1 is simplified.

It will be understood that other modifications and/or adaptations may be made to the mounting device, which has just been described without departing from the scope of the invention defined by the annexed claims. In particular, in another embodiment, body 8 could be fixed and collector member 20 mobile, or body 8 and collector member 20 could both be mobile. One could also envisage in a simplified embodiment replacing sleeve-shaped collector member 20 with a collector member comprising a deflector associated with an outlet channel connected either to the sewerage system or to a closed circuit.

What is claimed is:

1. A fluid dispensing device comprising: a self-cleaning dispensing nozzle having an outlet; a body having an exterior surface and being provided with a conduit having a first end to which the dispensing nozzle is connected and a second end which can receive a fluid inlet line; a collector member which can move relative to the body between a first dispensing position in which the nozzle outlet is released from the collector member and a second cleaning position in which the collector member forms with the body a cleaning chamber to clean the nozzle by collecting fluid that exits the nozzle outlet.

2. The dispensing device according to claim 1, wherein the collector member comprises a sleeve having an inner wall and in which the body and dispensing nozzle are guided and slide in an axial direction.

3. The dispensing device according to claim 2, wherein, in the cleaning position, the inner wall of the sleeve and the exterior surface of the body define the cleaning chamber and in that the dispensing nozzle outlet extends into the chamber so that both interior and exterior surfaces of the dispensing nozzle can be cleaned.

4. The dispensing device according to claim 3, wherein the cleaning chamber includes a drain orifice arranged in a lower wall of the sleeve.

5. The dispensing device according to claim 3, which further comprises two sealing gaskets arranged about the dispensing nozzle outlet. wherein, in the cleaning position, the chamber is sealed by the two sealing gaskets.

6. The dispensing device according to claim 2, wherein the dispensing nozzle includes an end portion provided with a collar which extends outside the sleeve whether the device is in the cleaning position or in the dispensing position.

7. The dispensing device according to claim 5, wherein one of the sealing gaskets is formed of a sealing joint arranged between a front surface of the sleeve and the collar.

8. The dispensing device according to claim 2, wherein the sleeve comprises a cylindrical portion extended by a converging truncated portion and the body comprises a first cylindrical section extended by a second section having a smaller diameter than the first section, with the second section extending at least partially into the truncated portion.

9. The dispensing device according to claim 8, wherein one of the sealing gaskets is formed of a sealing joint arranged between an inner wall of the cylindrical section of the sleeve and the exterior surface of the first section of the body.

10. The dispensing device according to claim 4, wherein the wall of the chamber arranged opposite the dispensing nozzle outlet is inclined towards the drain orifice.

11. The dispensing device according to claim 2, wherein the sleeve is mounted in fixation brackets which are secured to a base plate.

12. The dispensing device according to claim 11, wherein the body is connected to actuating means that are secured to the base plate, with the actuating means bringing the dispensing device respectively into the dispensing and cleaning positions in response to a control signal.

13. The dispensing device according to claim 1, wherein the conduit is inclined with respect to a horizontal line.

14. The dispensing device according to claim 13, wherein the dispensing nozzle includes a fluid dispensing cone, with the inclination of the conduit being such that the axis of the cone is substantially vertical.

15. A method for cleaning or rinsing a dispensing nozzle of a fluid dispensing device comprising: the dispensing nozzle; a body having an exterior surface and being provided with a conduit having a first end to which the dispensing nozzle is connected and a second end which can receive a fluid inlet line; a collector member which can move relative to the body between a first dispensing position in which the nozzle outlet is released from the collector member and a second cleaning position in which the collecting member forms with the body a cleaning chamber, with the nozzle being initially in the dispensing position, the method comprising the steps of:

placing the nozzle facing the collector member;

flowing a cleaning or rinsing fluid through the conduit, nozzle, and in the cleaning chamber;

collecting the cleaning or rinsing fluid that exits the nozzle in the collector member; and replacing the nozzle back into the initial position.

16. The method according to claim 15, wherein the flowing step includes flowing the cleaning fluid through the conduit via pumping means.

17. A method for cleaning or rinsing a dispensing nozzle of a fluid dispensing device comprising: the dispensing nozzle; a body having an exterior surface and being provided with a conduit having a first end to which the dispensing nozzle is connected and a second end which can receive a fluid inlet line; a collector member which can move relative to the body between a first dispensing position in which the nozzle outlet is released from the collector member and a second cleaning position, with the nozzle being initially in the first dispensing position, the method comprising the steps of:

placing the nozzle in the second cleaning position and facing the collector member;

flowing a cleaning or rinsing fluid through the conduit and nozzle;

collecting the cleaning or rinsing fluid that exits the nozzle in the collector member;

replacing the nozzle back into the initial position; and circulating the cleaning or rinsing fluid in a closed circuit.

18. The method according to claim 15, wherein the cleaning or rinsing fluid is chosen from the group consisting of caustic soda solutions, low foaming dishwasher solutions, optionally including surfactants or materials that break down proteins, chlorinated solutions and phenolated solutions.

19. A method for setting the temperature of a dispensing nozzle of a fluid dispensing machine comprising: the dispensing nozzle; a body having an exterior surface and being provided with a conduit having a first end to which the dispensing nozzle is connected and a second end which can receive a fluid inlet line; a collector member which can move relative to the body between a first dispensing position in which the nozzle outlet is released from the collector member and a second temperature setting position in which the collector member is placed in front of the nozzle outlet, with the nozzle being initially in the dispensing position, the method comprising the steps of:

placing the nozzle facing the collector member;

causing a temperature setting fluid to flow at a determined temperature through the conduit and nozzle; and collecting the fluid coming out of the nozzle in the collector member; and then replacing said nozzle in the initial position.

20. The method according to claim 19, wherein the temperature setting fluid is steam or hot water.

21. The method according to claim 20, wherein the temperature setting fluid is steam and is provided in a quantity of between about 0.5 and 5 ml.

* * * * *